US005882135A

United States Patent [19]

Ko

[11] Patent Number: 5,882,135

[45] Date of Patent: Mar. 16, 1999

[54] RING BINDER ASSEMBLY

[75] Inventor: Chung Nin Ko, Kowloon, Hong Kong

[73] Assignee: Hong Kong Stationery Mfg. Co., Ltd., Kowloon, Hong Kong

[21] Appl. No.: 916,790

[22] Filed: Aug. 25, 1997

[51] Int. Cl.[6] ..... B42F 3/04

[52] U.S. Cl. ..... 402/36; 402/26; 402/31; 402/73; 281/36

[58] Field of Search ..... 402/26, 31, 36, 402/37, 38, 39, 40, 41, 42, 73; 281/29, 36

[56] References Cited

U.S. PATENT DOCUMENTS 3,809,485 5/1974 Beyer ..... 402/31

5,158,387 10/1992 Davies ..... 402/31 X 5,755,513 5/1998 To ..... 402/36

*Primary Examiner*—Willmon Fridie, Jr.

*Attorney, Agent, or Firm*—Shoemaker and Mattare, Ltd.

[57] ABSTRACT

A ring binder assembly includes a folder comprising front and rear flaps interconnected by a spine, a pair of low-profile receptacles attached to an inner surface of the spine, and a ring mechanism whose tubular rivets have mushroomed feet designed to be seated in the receptacles. The receptacles open in opposite directions so that the ring mechanism is installed with a swiveling motion.

A method of shipping the binders, unassembled, is to place a stack of a number of folder opened flat in a box, leaving just sufficient head space for a corresponding number of ring mechanisms arranged side-by-side in a single row at the top of the box. The binder assemblies can be quickly completed by the retailer, or by the end purchaser.

3 Claims, 2 Drawing Sheets

RING BINDER ASSEMBLY

BACKGROUND OF THE INVENTION

This invention relates to ring binders. As used herein, the term "ring binder assembly" means an empty folder or book having a spine, in combination with a metal ring mechanism attachable to the spine. A typical ring mechanism comprises a metal shell riveted along the spine, a pair of hinged leaves retained in compression by the shell, and opposed half-rings attached to both leaves in such a way that the half-rings can be snapped closed to retain punched papers in the binder.

A ring mechanisms of the sort contemplated by this invention is shown and described in U.S. Pat. No. 4,552,478, the disclosure of which is incorporated into this specification.

Ring binders such as the well-known three-ring binder are normally permanently assembled at the factory, then boxed and shipped. A consequence is that, particularly for binders having wide spines, shipping density is low: even though the binders are alternated in direction as they are packed in cartons, most of the volume of the cartons is air. Because low shipping density results in high transportation costs, and shipping costs are a large part of the delivered cost of ring binders, it would be advantageous to achieve higher shipping densities.

SUMMARY OF THE INVENTION

An object of the invention is to increase the number of ring binders that can be packed into a given shipping box.

Another object of the invention is to produce a ring binder which has a competitive advantage over other binders because of reduced shipping costs.

These and other objects are attained by a ring binder assembly including a folder comprising front and rear flaps interconnected by a spine, at least one low-profile connecter attached to an inner surface of the spine, and a ring mechanism having a rivet head or other means for engaging the low-profile connecter. By "low-profile", we mean not thicker than the spine of the folder. The connecter is preferably one that can be secured quickly, without tools. As an example, two receptacles are secured to the spine, and each is designed so that the mushroomed foot of a respective one of a pair of rivets extending from the rear of the ring mechanism slide into the receptacle. Most preferably, the receptacles open in opposite directions so that the ring mechanism is installed by swiveling it.

A method of shipping the binders, unassembled, is to place a stack of a number of folders opened flat in a carton having just sufficient head space for a corresponding number of ring binders arranged side-by-side in a single row at the top of the box. By thus maximizing shipping density, per-unit freight costs are reduced. The binder assemblies can be quickly completed at the point of sale, or by the end purchaser.

BRIEF DESCRIPTION OF THE DRAWINGS

In the accompanying drawings.

DESCRIPTION OF THE PREFERRED EMBODIMENT

Figure 1:
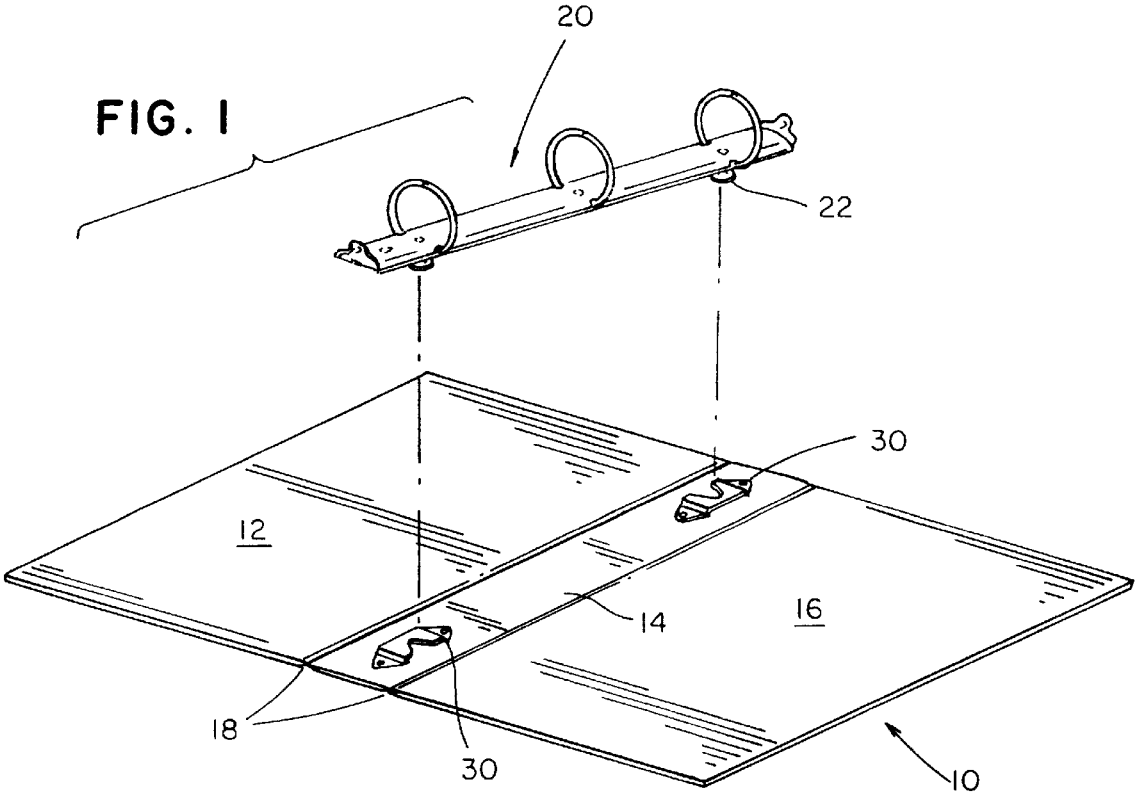
FIG. 1 is an exploded perspective view of a ring binder assembly embodying the invention.

A ring binder assembly embodying the invention is shown in FIG. 1. The assembly comprises a folder 10, having reinforced front and rear flaps 12, 14 interconnected by a spine 16. Flexure occurs along hinge lines 18 at either side of the spine formed for example by a narrow unreinforced layers of plastic which also cover the reinforcement in the spine and the flaps.

Figure 2:
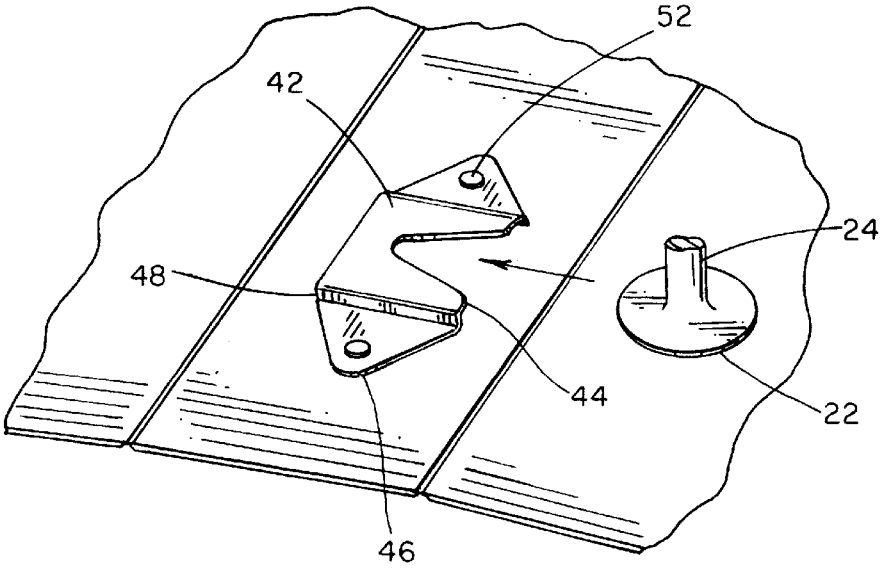
FIG. 2 is a perspective view, from above, of a low-profile fastener attached to the spine of the binder.
Figure 3:
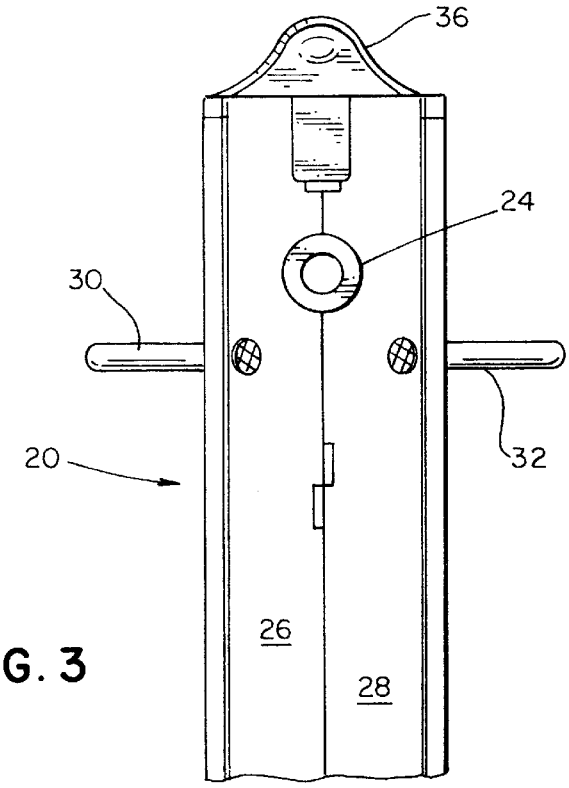
FIG. 3 is a bottom view of the ring mechanism portion of the assembly.

The ring mechanism 20 may be attached to the folder by sliding the mushroomed feet 22 (FIG. 3) of its tubular rivets 24 into the low-profile receptacles 40 shown in detail in FIG. 2, until the heads are secured beneath the center portion of the receptacles. In FIG. 3, one can see the bottoms of the leaves 26,28 and the ring halves 30,32 extending upward from the shell 34. The leaves have interdigitated fingers which cause them to act as a hinge, and their outer edges seat in grooves formed at the edges of the shell, which acts as a compression spring. The end lever 36, when pressed outward, pushes the leaves upward, flattening the shell slightly as they pass center, and opening the rings.

The receptacle 40 shown in FIG. 2 is stamped from sheet metal, and includes a planar center portion 42 having a U-shaped cutout 44 as wide as the diameter of the tubular rivets 24, and intersecting a side of the center portion. A pair of tabs 46 are formed at opposite ends of the center portion, each offset at 48 downward from the center section by at least the thickness of the tubular rivet's head, so that the mushroomed foot 22 of the rivet can seat within the space beneath the center section as suggested by the arrow. Each receptacle is permanently attached to the spine. In the example illustrated, each tab 46 has a hole (not shown) for receiving a fastener such as a rivet 52 extending upward from the spine.

Figure 4:
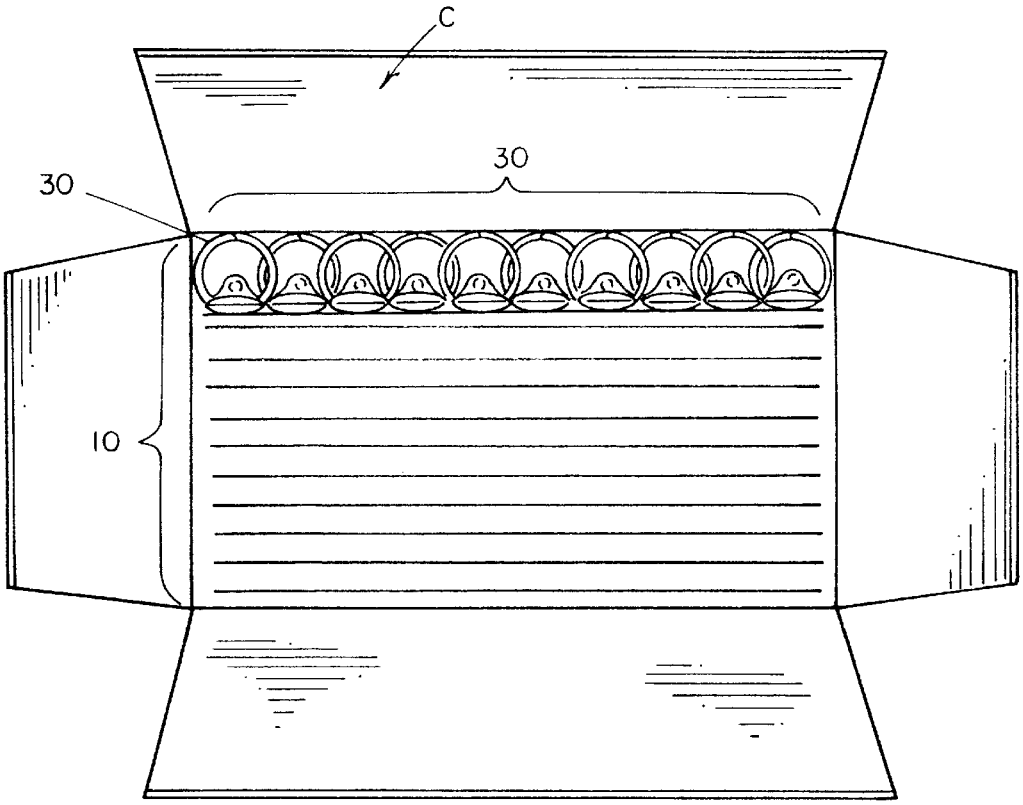
FIG. 4 is an end view looking into a box which has been packed with a number of flat folders and a like number of ring mechanisms arranged in a row along at the top of the box.

The high-density shipping advantage of this invention can be realized when the assembly described two paragraphs above is performed by the retailer or end-user. FIG. 4 shows a shipping carton "C", prior to closing, which has been filled with a number of (e.g. eighteen) folders laid flat so that no space is wasted. A corresponding number of ring mechanisms have been placed, side-by-side, in the remaining space at the top of the carton. One might also arrange the ring mechanisms back-to-back, in pairs, interleaving the opposing rings between pair. In any event, the height of the carton, and the number of binders per carton, may be optimized by the shipper to get the maximum shipping density.

I have described the best mode of the invention presently contemplated, particularly as to the nature of the connectors. It should be understood, however, that the advantages of the invention can be realized with any number of variant connectors. For now, a slide-in type fastener seems best, and I prefer to that they be oriented in opposite lateral directions to better resist accidental dislodgment. One may, however, prefer to orient them the same way, either parallel to or widthwise of the spine.

While the connection described above includes a receptacle (female connector) attached to the spine, and a rivet foot(male connector) on the ring mechanism, it is within the contemplated scope of this invention to reverse the gender of the connectors (i.e., receptacle on the ring mechanism), or to use hermaphroditic or sexless connectors. What is important is that, whatever connector couple is selected, that the portion attached to the spine have a low profile, so that the height of the stack is minimized, and that the connection be simple to make by unskilled people, preferable without tools. It may, however, prove advantageous to select a connection requiring a tool for disassembly.

Since the invention is subject to modifications and variations, it is intended that the foregoing description and the accompanying drawings shall be interpreted as only illustrative of the invention defined by the following claims.

I claim:

1. In a ring binder assembly comprising a folder including front and rear flaps interconnected by a spine, a ring mechanism having ring halves movable between open and closed positions, and connectors for securing the ring mechanism to the spine, the improvement wherein said connectors include a mating pair of connectors, one of which is permanently affixed to the spine, and the other of which is permanently connected to the ring mechanism, whereby the folders and ring mechanisms can be shipped prior to final assembly by an end user, the connector affixed to the spine is a receptacle and the connector secured to the ring mechanism is a rivet, and the receptacle includes a planar center portion having a U-shaped cutout intersecting a side of the center portion, a pair of tabs formed at opposite ends of the center portion, each tab being offset downward from the center section by at least the thickness of the rivet's foot, so that the foot can seat within the space beneath the center section, and means for securing each tab to said spine.

2. The invention of claim 1, wherein two of said receptacles are attached to the spine, and the U-shaped cutouts are arranged facing in opposite directions.

3. A method of achieving high-density shipping of ring binders, comprising steps of providing a plurality of ring binder folders each having a spine with at least one low-profile connector affixed to the spine, and a like plurality of separate ring mechanisms each having means for engaging in said connector to form a ring binder assembly, forming a stack of said folders, laid out flat, inserting said stack into a carton having sufficient head space to receive in addition said ring mechanisms arranged in a row and filling the head space with an equal number of ring mechanisms for subsequent assembly with said folders.

* * * * *